US010823464B2

(12) United States Patent
Schroeder et al.

(10) Patent No.: US 10,823,464 B2
(45) Date of Patent: Nov. 3, 2020

(54) ELASTO-CALORIC HEAT PUMP SYSTEM

(71) Applicant: Haier US Appliance Solutions, Inc., Wilmington, DE (US)

(72) Inventors: Michael Goodman Schroeder, Louisville, KY (US); Michael Alexander Benedict, Palo Alto, CA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 198 days.

(21) Appl. No.: 15/839,178

(22) Filed: Dec. 12, 2017

(65) Prior Publication Data

US 2019/0178536 A1 Jun. 13, 2019

(51) Int. Cl.
*F25B 23/00* (2006.01)
*F25D 11/00* (2006.01)
*F25D 17/02* (2006.01)

(52) U.S. Cl.
CPC ..... *F25B 23/00* (2013.01); *F25D 11/00* (2013.01); *F25D 17/02* (2013.01)

(58) Field of Classification Search
CPC ..... F25B 23/00; F25D 11/00; F25D 17/02
USPC ..... 62/440
See application file for complete search history.

(56) References Cited

U.S. PATENT DOCUMENTS 3,888,303 A * 6/1975 Skala ..... A47J 27/17 165/300
4,549,155 A * 10/1985 Halbach ..... H01F 7/0278 335/212
4,639,673 A * 1/1987 Zijlstra ..... G01R 33/383 324/318
4,642,994 A * 2/1987 Barclay ..... F25B 21/00 505/890
4,916,907 A * 4/1990 Munk ..... H02N 11/002 62/3.1
5,024,059 A * 6/1991 Noble ..... F04D 23/001 62/3.1
5,091,361 A * 2/1992 Hed ..... F25B 21/00 257/E39.018
5,156,003 A * 10/1992 Yoshiro ..... F25B 21/00 505/891
5,156,004 A * 10/1992 Wu ..... H01L 35/26 136/203
5,182,914 A * 2/1993 Barclay ..... F25B 21/00 505/889
5,339,653 A * 8/1994 DeGregoria ..... A62B 9/003 165/10
5,617,913 A * 4/1997 DeGregoria ..... A61M 16/1045 128/201.13

(Continued)

FOREIGN PATENT DOCUMENTS

CA 1057964 A1 7/1979
CN 106052190 A 10/2016

*Primary Examiner* — Len Tran
*Assistant Examiner* — Kirstin U Oswald
(74) *Attorney, Agent, or Firm* — Dority & Manning, P.A.

(57) ABSTRACT

A caloric heat pump includes a plurality of elasto-caloric stages. The plurality of elasto-caloric stages is distributed between along an axial direction within a chamber of a housing. Each elasto-caloric stage includes a hub, a rim and a plurality of elasto-caloric spokes. The plurality of elasto-caloric spokes extend between the hub and the rim along a radial direction. The plurality of elasto-caloric stages is rotatable about the axial direction.

20 Claims, 3 Drawing Sheets

(56) References Cited

U.S. PATENT DOCUMENTS 5,701,891 A * 12/1997 Groenke ..... A61M 16/1045 128/201.13
5,727,616 A * 3/1998 Groenke ..... A62B 9/003 165/4
6,332,323 B1 * 12/2001 Reid ..... F25B 29/003 62/6
6,806,621 B2 * 10/2004 Heim ..... H02N 2/046 310/328
7,897,898 B2 * 3/2011 Muller ..... F25B 21/00 219/672
8,736,128 B2 * 5/2014 Dede ..... H02K 1/08 310/191
8,754,569 B2 * 6/2014 Kuo ..... H02N 10/00 310/306
8,769,966 B2 * 7/2014 Heitzler ..... F25B 21/00 62/3.1
9,377,221 B2 * 6/2016 Benedict ..... F25B 21/00
9,625,185 B2 * 4/2017 Benedict ..... F25B 21/00
9,631,842 B1 * 4/2017 Dariavach ..... F25B 21/00
9,851,128 B2 * 12/2017 Benedict ..... F25B 21/00
9,857,105 B1 * 1/2018 Schroeder ..... F25B 21/00
9,869,493 B1 * 1/2018 Benedict ..... F25B 41/04
9,885,500 B2 * 2/2018 Watanabe ..... F25B 21/00
10,054,340 B2 * 8/2018 Watanabe ..... F25B 21/00
10,119,059 B2 * 11/2018 Cui ..... F25B 23/00
10,254,020 B2 * 4/2019 Benedict ..... F25B 21/00
10,274,231 B2 * 4/2019 Schroeder ..... F04B 1/053
2002/0108381 A1 * 8/2002 Bell ..... F02G 1/043 62/3.3
2006/0288729 A1 * 12/2006 Arjomand ..... F24F 1/027 62/441
2010/0071383 A1 * 3/2010 Zhang ..... F25B 21/00 62/3.1
2011/0121582 A1 * 5/2011 Alexander ..... F03G 7/06 290/1 R
2011/0124451 A1 * 5/2011 Alexander ..... F02G 5/04 474/139
2011/0247731 A1 * 10/2011 Gordon ..... C22F 1/10 148/561
2012/0247706 A1 * 10/2012 Cui ..... C22C 14/00 165/10
2012/0273158 A1 * 11/2012 Cui ..... F25B 23/00 165/10
2012/0285179 A1 * 11/2012 Morimoto ..... F25B 41/04 62/3.1
2013/0303909 A1 * 11/2013 Kang ..... A61B 5/0095 600/443
2013/0327062 A1 * 12/2013 Watanabe ..... F25B 21/00 62/3.1
2014/0157793 A1 * 6/2014 Johnson ..... C22F 1/16 62/3.1
2014/0165594 A1 * 6/2014 Benedict ..... F25B 21/00 62/3.1
2014/0190182 A1 * 7/2014 Benedict ..... F25B 21/00 62/3.1
2014/0295365 A1 * 10/2014 Casset ..... B81B 3/0024 432/1
2015/0362224 A1 * 12/2015 Benedict ..... F25B 21/00 62/3.1
2016/0006373 A1 * 1/2016 Conard ..... H02N 2/18 310/306
2016/0084544 A1 * 3/2016 Radermacher ..... F25B 23/00 165/10
2016/0116226 A1 * 4/2016 Dupont ..... B60H 1/00492 165/104.21
2016/0216012 A1 * 7/2016 Benedict ..... F25B 21/00
2016/0238287 A1 * 8/2016 Benedict ..... F25B 21/00
2016/0348222 A1 * 12/2016 Isaac ..... C22C 38/30
2017/0314814 A1 * 11/2017 Benedict ..... F24H 4/04
2018/0023862 A1 * 1/2018 Schroeder ..... F25D 11/02 62/3.1
2018/0156502 A1 * 6/2018 Benedict ..... F25B 21/00
2018/0156503 A1 * 6/2018 Benedict ..... F25B 21/00
2018/0283738 A1 * 10/2018 Schroeder ..... F25B 21/00
2019/0323742 A1 * 10/2019 Schroeder ..... F25B 21/00

* cited by examiner

ELASTO-CALORIC HEAT PUMP SYSTEM

FIELD OF THE INVENTION

The present subject matter relates generally to heat pumps, such as elasto-caloric heat pumps, for appliances.

BACKGROUND OF THE INVENTION

Conventional refrigeration technology typically utilizes a heat pump that relies on compression and expansion of a fluid refrigerant to receive and reject heat in a cyclic manner so as to effect a desired temperature change or transfer heat energy from one location to another. This cycle can be used to receive heat from a refrigeration compartment and reject such heat to the environment or a location that is external to the compartment. Other applications include air conditioning of residential or commercial structures. A variety of different fluid refrigerants have been developed that can be used with the heat pump in such systems.

While improvements have been made to such heat pump systems that rely on the compression of fluid refrigerant, at best such can still only operate at about forty-five percent or less of the maximum theoretical Carnot cycle efficiency. Also, some fluid refrigerants have been discontinued due to environmental concerns. The range of ambient temperatures over which certain refrigerant-based systems can operate may be impractical for certain locations. Other challenges with heat pumps that use a fluid refrigerant exist as well.

Elasto-caloric materials (ECMs), i.e. materials that exhibit the elasto-caloric effect, provide a potential alternative to fluid refrigerants for heat pump applications. In general, ECMs exhibit a change in temperature in response to a change in strain. The theoretical Carnot cycle efficiency of a refrigeration cycle based on an ECM can be significantly higher than for a comparable refrigeration cycle based on a fluid refrigerant. As such, a heat pump system that can effectively use an ECM would be useful.

Challenges exist to the practical and cost competitive use of an ECM, however. In addition to the development of suitable ECMs, equipment that can attractively utilize an ECM is still needed. Currently proposed equipment may require relatively large and expensive mechanical systems, may be impractical for use in e.g., appliance refrigeration, and may not otherwise operate with enough efficiency to justify capital cost.

Accordingly, a heat pump system that can address certain challenges, such as those identified above, would be useful. Such a heat pump system that can also be used in a refrigerator appliance would also be useful.

BRIEF DESCRIPTION OF THE INVENTION

The present subject matter provides a caloric heat pump. The caloric heat pump includes a plurality of elasto-caloric stages. The plurality of elasto-caloric stages is distributed between along an axial direction within a chamber of a housing. Each elasto-caloric stage includes a hub, a rim and a plurality of elasto-caloric spokes. The plurality of elasto-caloric spokes extend between the hub and the rim along a radial direction. The plurality of elasto-caloric stages is rotatable about the axial direction. Additional aspects and advantages of the invention will be set forth in part in the following description, or may be apparent from the description, or may be learned through practice of the invention.

In a first example embodiment, a heat pump system includes a hot side heat exchanger and a cold side heat exchanger. A pump is operable to flow a working fluid between the hot and cold side heat exchangers. A caloric heat pump includes a housing that extends along an axial direction between a first end portion of the housing and a second end portion of the housing. The housing defines a chamber that extends longitudinally along the axial direction between the first and second end portions of the housing. A plurality of elasto-caloric stages is distributed between the first and second end portions of the housing along the axial direction within the chamber of the housing. Each elasto-caloric stage of the plurality of elasto-caloric stages includes a hub, a rim and a plurality of elasto-caloric spokes that extend between the hub and the rim along a radial direction. The plurality of elasto-caloric stages is rotatable about the axial direction.

In a second example embodiment, a refrigerator appliance includes a cabinet that defines a chilled chamber. A cold side heat exchanger is positioned within the chilled chamber. A hot side heat exchanger is positioned within the cabinet and outside the chilled chamber. A pump is operable to flow a working fluid between the hot and cold side heat exchangers. A caloric heat pump includes a housing that extends along an axial direction between a first end portion of the housing and a second end portion of the housing. The housing defines a chamber that extends longitudinally along the axial direction between the first and second end portions of the housing. A plurality of elasto-caloric stages is distributed between the first and second end portions of the housing along the axial direction within the chamber of the housing. Each elasto-caloric stage of the plurality of elasto-caloric stages includes a hub, a rim and a plurality of elasto-caloric spokes that extend between the hub and the rim along a radial direction. The plurality of elasto-caloric stages is rotatable about the axial direction.

In a third example embodiment, a caloric heat pump includes a housing that extends along an axial direction between a first end portion of the housing and a second end portion of the housing. The housing defines a chamber that extends longitudinally along the axial direction between the first and second end portions of the housing. A plurality of elasto-caloric stages is distributed between the first and second end portions of the housing along the axial direction within the chamber of the housing. Each elasto-caloric stage of the plurality of elasto-caloric stages includes a hub, a rim and a plurality of elasto-caloric spokes. The plurality of elasto-caloric spokes extend between the hub and the rim along a radial direction. The plurality of elasto-caloric stages is rotatable about the axial direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
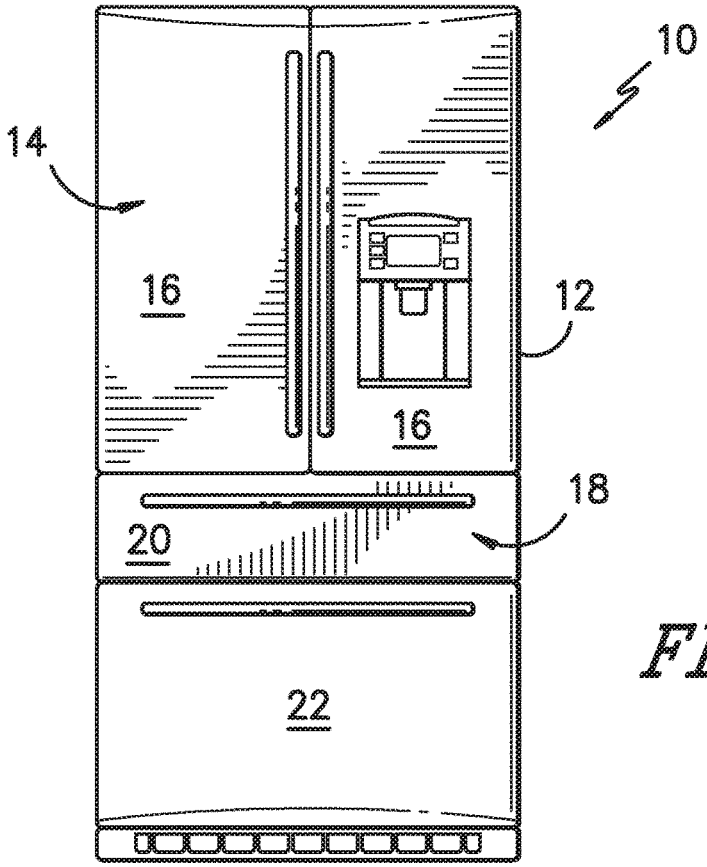
FIG. 1 provides an example embodiment of a refrigerator appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an example embodiment of a refrigerator appliance 10 is depicted as an upright refrigerator having a cabinet or casing 12 that defines a number of internal storage compartments or chilled chambers. In particular, refrigerator appliance 10 includes upper fresh-food compartments 14 having doors 16 and lower freezer compartment 18 having upper drawer 20 and lower drawer 22. The drawers 20, 22 are "pull-out" type drawers in that they can be manually moved into and out of the freezer compartment 18 on suitable slide mechanisms.

Refrigerator 10 is provided by way of example only. Other configurations for a refrigerator appliance may be used as well including appliances with only freezer compartments, only chilled compartments, or other combinations thereof different from that shown in FIG. 1. In addition, the heat pump and heat pump system of the present invention is not limited to appliances and may be used in other applications as well such as e.g., air-conditioning, electronics cooling devices, and others. Further, it should be understood that while the use of a heat pump to provide cooling within a refrigerator is provided by way of example herein, the present invention may also be used to provide for heating applications as well.

Figure 2:
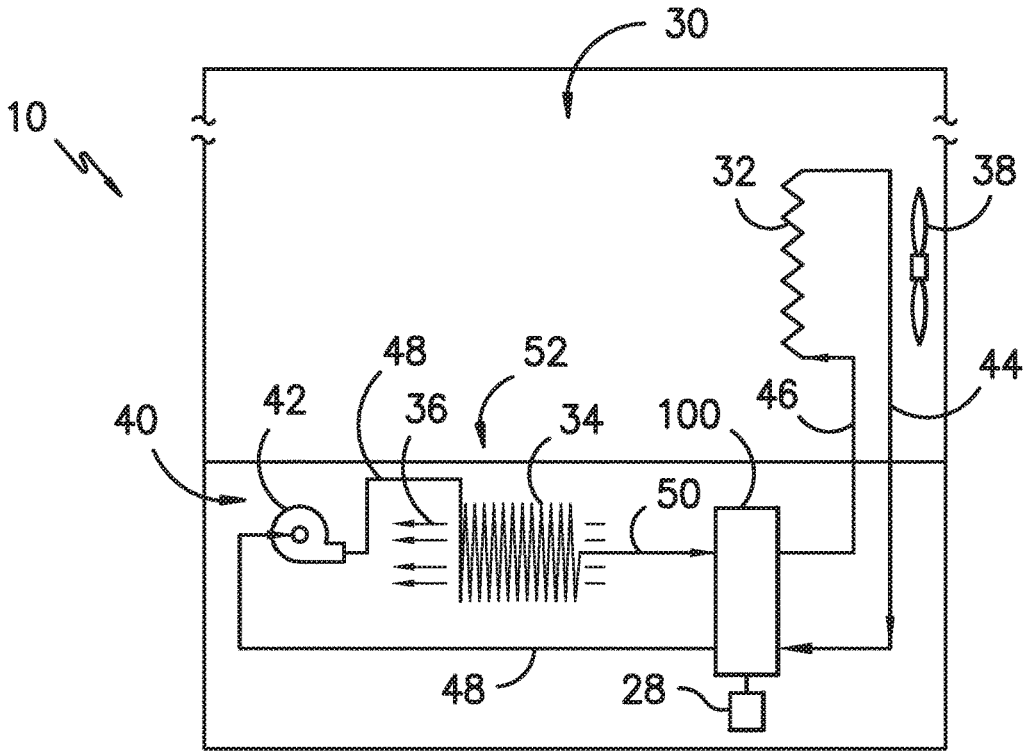
FIG. 2 is a schematic illustration of a heat pump system of the example refrigerator appliance of FIG. 1.

FIG. 2 is a schematic view of the refrigerator appliance 10. As may be seen in FIG. 2, refrigerator appliance 10 includes a refrigeration compartment 30 and a machinery compartment 40. Machinery compartment 30 includes a heat pump system 52 having a first heat exchanger 32 positioned in the refrigeration compartment 30 for the removal of heat therefrom. A heat transfer fluid such as e.g., an aqueous solution, flowing within first heat exchanger 32 receives heat from the refrigeration compartment 30 thereby cooling contents of the refrigeration compartment 30. A fan 38 may be used to provide for a flow of air across first heat exchanger 32 to improve the rate of heat transfer from the refrigeration compartment 30.

The heat transfer fluid flows out of first heat exchanger 32 by line 44 to heat pump 100. As will be further described herein, the heat transfer fluid receives additional heat from caloric material in heat pump 100 and carries this heat by line 48 to pump 42 and then to second heat exchanger 34. Heat is released to the environment, machinery compartment 40, and/or other location external to refrigeration compartment 30 using second heat exchanger 34. A fan 36 may be used to create a flow of air across second heat exchanger 34 and thereby improve the rate of heat transfer to the environment. Pump 42 connected into line 48 causes the heat transfer fluid to recirculate in heat pump system 52. Motor 28 is in mechanical communication with heat pump 100 as will further described.

From second heat exchanger 34 the heat transfer fluid returns by line 50 to heat pump 100 where, as will be further described below, the heat transfer fluid loses heat to the caloric material in heat pump 100. The now colder heat transfer fluid flows by line 46 to first heat exchanger 32 to receive heat from refrigeration compartment 30 and repeat the cycle as just described.

Heat pump system 52 is provided by way of example only. Other configurations of heat pump system 52 may be used as well. For example, lines 44, 46, 48, and 50 provide fluid communication between the various components of the heat pump system 52 but other heat transfer fluid recirculation loops with different lines and connections may also be employed. For example, pump 42 can also be positioned at other locations or on other lines in system 52. Still other configurations of heat pump system 52 may be used as well. For example, heat pump system 52 may be configured such that the caloric material in heat pump 100 directly cools air that flows through refrigeration compartment 30 and directly heats air external to refrigeration compartment 30. Thus, system 52 need not include a liquid working fluid in certain example embodiments.

Figure 3:
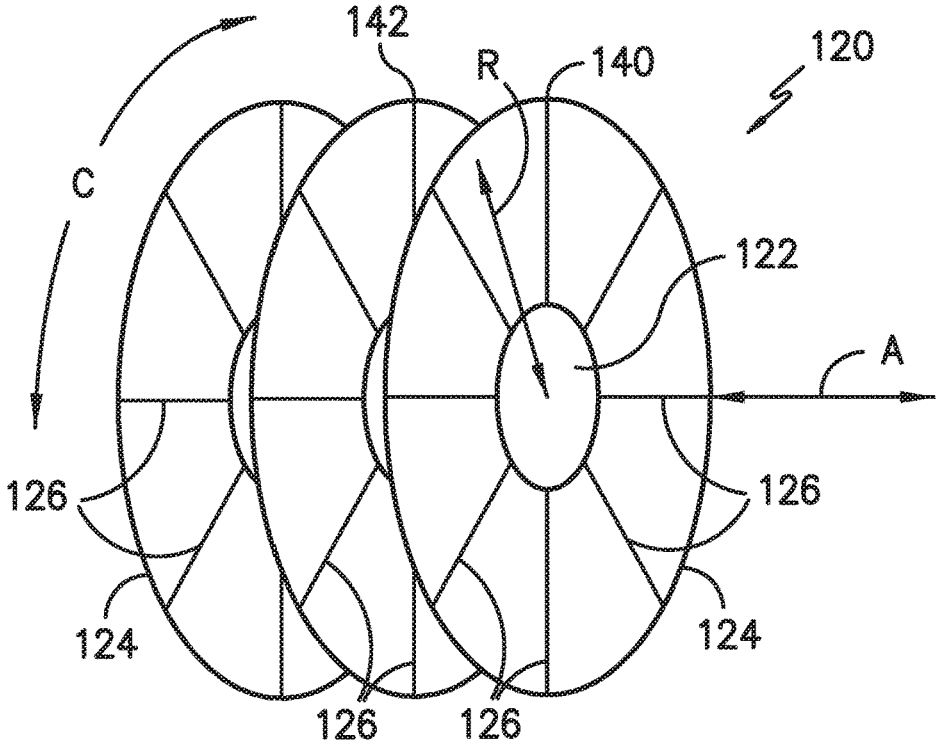
FIG. 3 is a perspective view of a plurality of elasto-caloric stages of the heat pump of FIG. 2.
Figure 5:
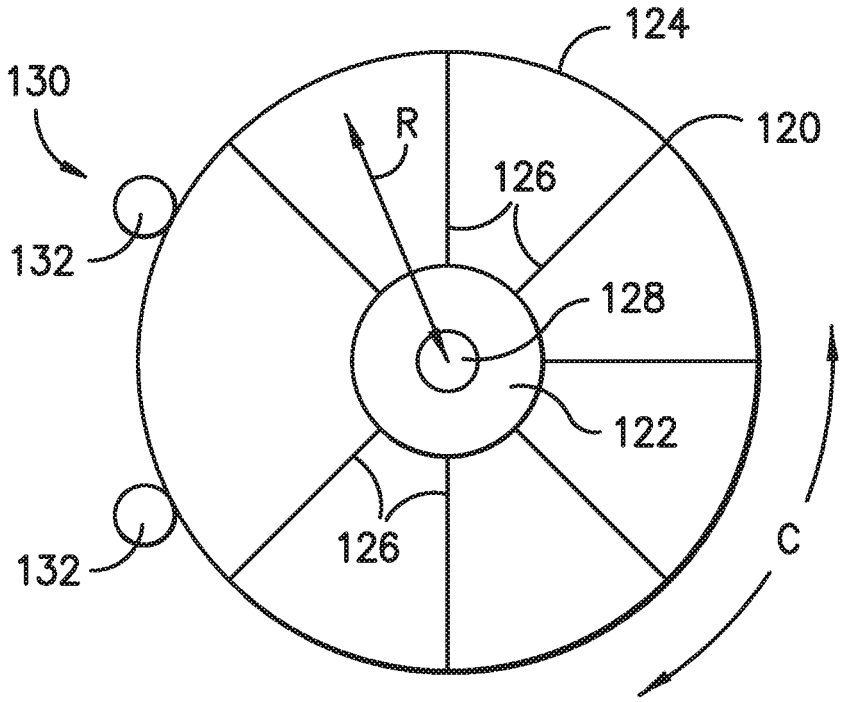
FIG. 5 is an elevation view of a force applicator and an elasto-caloric stage of the heat pump of FIG. 2.
Figure 6:
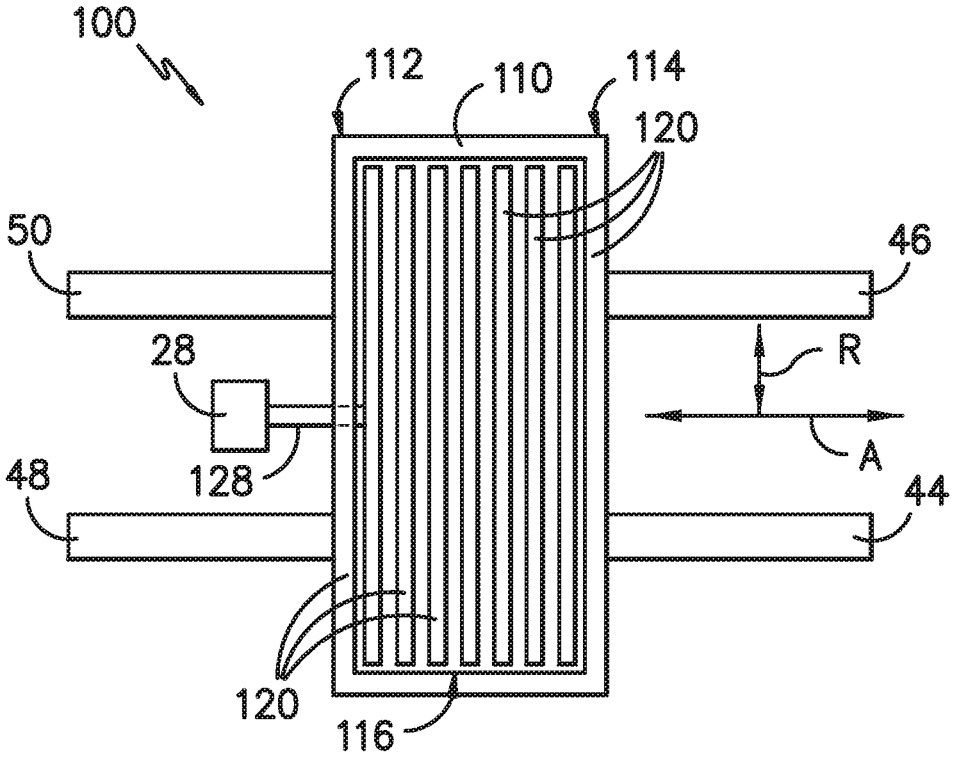
FIG. 6 is a section view of a housing and the plurality of elasto-caloric stages of the heat pump of FIG. 2.

Turning now to FIGS. 3, 5 and 6, heat pump 100 includes a housing 110 (FIG. 6), a plurality of elasto-caloric stages 120 and a force applicator 130. As may be seen in FIG. 6, housing 110 extends between a first end portion 112 and a second end portion 114, e.g., along an axial direction A. Housing 110 also defining a chamber 116 therein. Chamber 116 extends longitudinally along the axial direction A between first and second end portions 112, 114 of housing 110. Housing 110 may be configured for containing fluid, such as an aqueous working fluid or air within chamber 116, in order to facilitate heat exchange between the fluid and elasto-caloric stages 120, as discussed in greater detail below.

Elasto-caloric stages 120 are positioned within chamber 116 of housing 110. In particular, elasto-caloric stages 120 may be distributed or between first and second end portions 112, 114 of housing 110 along the axial direction A within chamber 116. Thus, e.g., elasto-caloric stages 120 may be stacked along the axial direction A within chamber 116. Although only three elasto-caloric stages 120 are shown in FIG. 3, heat pump 100 may include any suitable number of stages 126, such as two, three, four, five or more stages 126. As a particular example, heat pump 100 may include seven stages 126, as shown in FIG. 6.

As may be seen in FIGS. 3 and 5, each stage of elasto-caloric stages 120 may include a hub 122, a rim 124 and a plurality of elasto-caloric spokes 126. Spokes 126 extend between hub 122 and rim 124 along a radial direction R. Spokes 126 may also be distributed along a circumferential direction C between hub 122 and rim 124. In particular, spokes 126 may be uniformly spaced along the circumferential direction C between hub 122 and rim 124, in certain example embodiments. As shown in FIG. 3, elasto-caloric stages 120 include a first stage 140 and a second stage 142 that are adjacent to each other within the stack of elasto-caloric stages 120. Spokes 126 of first stage 140 may be aligned with spokes 126 of second stage 142 along the axial direction A. The spokes 126 of other elasto-caloric stages 120 may also be aligned with spokes 126 of adjacent elasto-caloric stages 120 in a similar manner.

Elasto-caloric stages 120 are rotatable about the axial direction A. In particular, each hub 122 of elasto-caloric stages 120 may be mounted to one another and/or a common axle 128, and motor 28 may be coupled to axle 128 such that axle 128, and thus elasto-caloric stages 120, is rotatable about the axial direction A by motor 28. As may be seen from the above, elasto-caloric stages 120 may be connected to each other such that elasto-caloric stages 120 rotate about the axial direction A at a common speed during operation of motor 28. Thus, rotation of elasto-caloric stages 120 may be synchronized so that each elasto-caloric spoke 126 of one of elasto-caloric stage 120 remains aligned with an adjacent spoke of another one of elasto-caloric stages 120 along the axial direction A in the stack of elasto-caloric spokes 126.

Elasto-caloric spokes 126 include one or more elasto-caloric materials. Thus, elasto-caloric spokes 126 change in temperature in response to deformation of elasto-caloric spokes 126. In particular, strain in elasto-caloric spokes 126 along the radial direction R may result in elasto-caloric spokes 126 changing temperature. Force applicator 130 is operable to deform elasto-caloric spokes 126 during rotation of elasto-caloric stages 120. In FIG. 5, force applicator 130 is a pair of rollers 132. However, it will be understood that force applicator 130 may be another suitable device for deforming elasto-caloric spokes 126, in alternative example embodiments.

Rollers 132 contact and roll on rim 124. For example, rollers 132 are configured for deforming a portion of rim 124 inwardly along the radial direction R such that one or more of spokes 126 proximate rollers relax and one or more of spokes 126 opposite rollers 132 stretch as elasto-caloric stages 120 rotate about the axial direction A. Thus, rollers 132 may be positioned to deform the portion of rim 124 that contacts rollers 132 inwardly along the radial direction R, and such deformation of rim 124 may change the strain of spokes 126.

The lengths of spokes 126 and the position of rollers 132 relative to hub 122 may be selected to adjust the strain in spokes 126 by an advantageous amount as elasto-caloric stages 120 rotate about the axial direction A. For example, spokes 126 may be strained between hub 122 and rim 124 such that the one or more of spokes 126 proximate rollers 132 has minimum strain and the one or more of spokes 126 opposite rollers 132 has a maximum strain. The minimum strain may be about zero percent (0%), and the maximum strain may be about three percent (3%). Thus, the one or more of spokes 126 proximate rollers 132 may be at their natural length, and the one or more of spokes 126 opposite rollers 132 may be strained to an amount below the elastic limit that provides a suitable temperature change within spokes 126. As used herein the term "about" means within half a percent of the stated percentage when used in the context of strains. It will be understood from the above that spokes 126 may be pre-strained between hub 122 and rim 124. For example, spokes 126 may be pre-strained to about one and a half percent (1.5%).

It will be understood that rollers 132 apply a relatively large force to rim in order to adjust the strain in spokes 126. However, heat pump 100 is force balanced by simultaneously stretching and relaxing spokes 126 meaning that the applied force is only required to meet thermodynamic requirements. However, cogging force occurs due to finite spacing between spokes 126, but such cogging force may be reduced by increasing the number of spokes 126. The force balancing in heat pump 100 avoids the large and non-constant force required by other heat pumps and thereby offers improved performance over such heat pumps.

Figure 4:
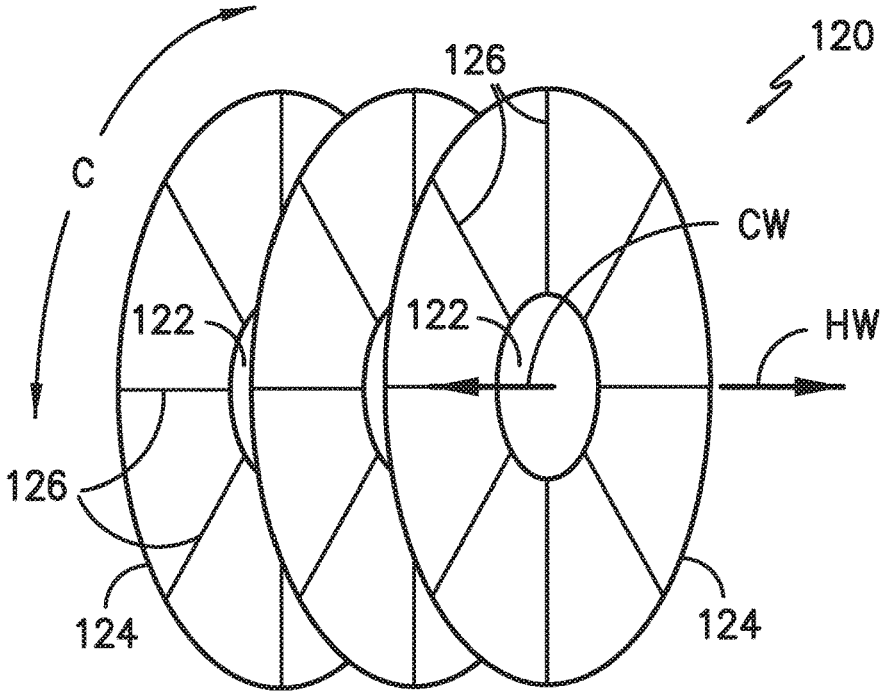
FIG. 4 is a perspective view of fluid flow through the plurality of elasto-caloric stages shown in FIG. 3.

FIG. 4 is a perspective view of fluid flow through elasto-caloric stages 120. As shown in FIG. 4, spokes 126 may extend longitudinally such that spokes 126 are arranged perpendicular to working fluid flow through elasto-caloric stages 120, and the working fluid may flow along the axial direction A through elasto-caloric stages 120. Turning to FIG. 5, working fluid is flowable through elasto-caloric stages 120, e.g., within chamber 116 of housing 110. For example, with reference to FIGS. 4 and 5, warm working fluid from first heat exchanger 32 may enter chamber 116 of housing 110 via line 44 at or adjacent the one or more of spokes 126 opposite rollers 132, and the working fluid receives additional heat from elasto-caloric material in spokes 126 as the spokes 126 reject heat under strain. The now warmer working fluid (shown with arrow HW in FIG. 4) may then exit chamber 116 of housing 110 via line 48 and flow to second heat exchanger 34 where heat is released to a location external to refrigeration compartment 30.

Continuing the example, cool working fluid (shown with arrow CW in FIG. 4) from second heat exchanger 34 may enter chamber 116 of housing 110 via line 50 at or adjacent the one or more of spokes 126 proximate rollers 132, and the working fluid rejects additional heat to elasto-caloric material in spokes 126 as the spokes 126 relax. The now cooler working fluid may then exit chamber 116 of housing 110 via line 46 and flow to first heat exchanger 32 and receive heat from refrigeration compartment 30. The above cycle may be repeated while rotation of elasto-caloric stages 120 (shown with arrow T in FIG. 4) continuously strains and relaxes spokes 126. As may be seen from the above, heat pump 100 stretches and relaxes spokes 126 and utilizes working fluid (liquid or gas) to harvest the thermal effect.

Although not shown, heat pump 100 may also include seals, baffles or other features to limit or prevent the working fluid flow along the circumferential direction C within housing 110. Thus, the warmer working fluid flow CW to second heat exchanger 34 may be separated from the cooler returning working fluid CW at one end of housing 110, and the cooler working fluid flow to first heat exchanger 32 may be separated from the warmer return fluid at the opposite end of housing 110.

In each stage 120, the elasto-caloric material within spokes 126 may show maximum effect only across a particular temperature span, e.g., fifteen degrees Celcius (15° C.). Thus, the elasto-caloric material in the stack of stages 120 may be selected to provide a larger collective temperature span. For example, spokes 126 of each elasto-caloric stage 120 may have a different elasto-caloric material and/or spokes 126 of each elasto-caloric stage 120 may have a different concentration of elasto-caloric material, such as nickel titanium alloy. As may be seen from the above, by tuning each elasto-caloric stage 120 to a different effective range, heat pump 100 may be a cascaded regenerative system that provides a larger temperature span than a single elasto-caloric material.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A heat pump system, comprising
a hot side heat exchanger;
a cold side heat exchanger;
a pump operable to flow a working fluid between the hot and cold side heat exchangers;
a caloric heat pump comprising
a housing extending along an axial direction between a first end portion of the housing and a second end portion of the housing, the housing defining a chamber that extends longitudinally along the axial direction between the first and second end portions of the housing; and
a plurality of elasto-caloric stages distributed between the first and second end portions of the housing along the axial direction within the chamber of the housing, each elasto-caloric stage of the plurality of elasto-caloric stages comprising a hub, a rim and a plurality of elasto-caloric spokes that extend between the hub and the rim along a radial direction,
wherein the plurality of elasto-caloric stages is rotatable about the axial direction, and
wherein the plurality of elasto-caloric spokes is prestrained to about one and a half percent between the hub and the rim.

2. The heat pump system of claim 1, wherein the caloric heat pump further comprises a pair of rollers contacting the rim.

3. The heat pump system of claim 2, wherein the pair of rollers is configured for deforming a portion of the rim along the radial direction such that one or more of the plurality of elasto-caloric spokes proximate the pair of rollers relax and one or more of the plurality of elasto-caloric spokes opposite the pair of rollers stretch as the plurality of elasto-caloric stages rotate about the axial direction.

4. The heat pump system of claim 2, wherein the plurality of elasto-caloric spokes are strained between the hub and the rim such that the one or more of the plurality of elasto-caloric spokes proximate the pair of rollers has minimum strain and the one or more of the plurality of elasto-caloric spokes opposite the pair of rollers has a maximum strain.

5. The heat pump system of claim 4, wherein the minimum strain is about zero percent.

6. The heat pump system of claim 1, wherein the working fluid is flowable through the plurality of elasto-caloric stages within the chamber of the housing.

7. The heat pump system of claim 1, wherein the hub of each elasto-caloric stage is mounted to a common axle.

8. The heat pump system of claim 1, wherein the plurality of elasto-caloric spokes of each of the plurality of elasto-caloric stages comprise a different elasto-caloric material.

9. The heat pump system of claim 1, wherein the plurality of elasto-caloric spokes of each of the plurality of elasto-caloric stages comprise a different concentration of elasto-caloric material.

10. The heat pump system of claim 1, wherein the plurality of elasto-caloric spokes comprises a nickel titanium alloy.

11. A refrigerator appliance, comprising:
a cabinet defining a chilled chamber;
a cold side heat exchanger positioned within the chilled chamber;
a hot side heat exchanger positioned within the cabinet and outside the chilled chamber;
a pump operable to flow a working fluid between the hot and cold side heat exchangers;
a caloric heat pump comprising
a housing extending along an axial direction between a first end portion of the housing and a second end portion of the housing, the housing defining a chamber that extends longitudinally along the axial direction between the first and second end portions of the housing; and
a plurality of elasto-caloric stages distributed between the first and second end portions of the housing along the axial direction within the chamber of the housing, each elasto-caloric stage of the plurality of elasto-caloric stages comprising a hub, a rim and a plurality of elasto-caloric spokes that extend between the hub and the rim along a radial direction,
wherein the plurality of elasto-caloric stages is rotatable about the axial direction, and
wherein the plurality of elasto-caloric spokes is prestrained to about one and a half percent between the hub and the rim.

12. The refrigerator appliance of claim 11, wherein the caloric heat pump further comprises a pair of rollers contacting the rim.

13. The refrigerator appliance of claim 12, wherein the pair of rollers is configured for deforming a portion of the rim along the radial direction such that one or more of the plurality of elasto-caloric spokes proximate the pair of rollers relax and one or more of the plurality of elasto-caloric spokes opposite the pair of rollers stretch as the plurality of elasto-caloric stages rotate about the axial direction.

14. The refrigerator appliance of claim 12, wherein the plurality of elasto-caloric spokes are strained between the hub and the rim such that the one or more of the plurality of elasto-caloric spokes proximate the pair of rollers has minimum strain and the one or more of the plurality of elasto-caloric spokes opposite the pair of rollers has a maximum strain.

15. The refrigerator appliance of claim 14, wherein the minimum strain is about zero percent.

16. The refrigerator appliance of claim 11, the working fluid is flowable through the plurality of elasto-caloric stages within the chamber of the housing.

17. The refrigerator appliance of claim 11, wherein the hub of each elasto-caloric stage is mounted to a common axle.

18. The refrigerator appliance of claim 11, wherein the plurality of elasto-caloric spokes of each of the plurality of elasto-caloric stages comprise a different elasto-caloric material.

19. The refrigerator appliance of claim 11, wherein the plurality of elasto-caloric spokes of each of the plurality of elasto-caloric stages comprise a different concentration of elasto-caloric material.

20. A caloric heat pump, comprising:
a housing extending along an axial direction between a first end portion of the housing and a second end portion of the housing, the housing defining a chamber that extends longitudinally along the axial direction between the first and second end portions of the housing; and
a plurality of elasto-caloric stages distributed between the first and second end portions of the housing along the axial direction within the chamber of the housing, each elasto-caloric stage of the plurality of elasto-caloric stages comprising a hub, a rim and a plurality of elasto-caloric spokes that extend between the hub and the rim along a radial direction, wherein the plurality of elasto-caloric stages is rotatable about the axial direction, and wherein the plurality of elasto-caloric spokes is pre-strained to about one and a half percent between the hub and the rim.

* * * * *